United States Patent [19]

Craig

[11] Patent Number: 4,580,423

[45] Date of Patent: Apr. 8, 1986

[54] GARAGE DOOR LOCK MECHANISM

[75] Inventor: Clark E. Craig, Simpsonville, S.C.

[73] Assignee: Keystone Consolidated Industries, Inc., Dallas, Tex.

[21] Appl. No.: 548,361

[22] Filed: Nov. 3, 1983

[51] Int. Cl.[4] ..... E05B 65/08

[52] U.S. Cl. ..... 70/100; 70/151 R; 292/153; 292/181

[58] Field of Search ..... 70/100, 99, 150, 151 R, 70/DIG. 52, DIG. 53, DIG. 54, DIG. 55; 292/153, 181

[56] References Cited

U.S. PATENT DOCUMENTS 3,010,749 11/1961 Brissette ..... 70/DIG. 54

3,306,086 2/1967 Hallgren ..... 70/100

*Primary Examiner*—Robert L. Wolfe

*Attorney, Agent, or Firm*—Allegretti, Newitt, Witcoff & McAndrews, Ltd.

[57] ABSTRACT

An improved garage door lock mechanism includes a housing, a crank, a slider, a catch and a single, multipurpose biasing member. The elements are adapted such that the biasing member both biases the slider from a locking position and biases the catch to catch the slider when the slider is in the locking position.

8 Claims, 5 Drawing Figures

GARAGE DOOR LOCK MECHANISM

BACKGROUND OF THE INVENTION

This invention relates to garage door locks.

A particularly desirable garage door lock mechanism is disclosed and described in U.S. Pat. No. 3,306,086 issued Feb. 28, 1967, to Charles G. Halgren, assignor to National Lock Company, a predecessor of the National Lock Division of Keystone Consolidated Industries, Incorporated of Rockford, Ill. This invention is an improvement of the invention of Mr. Halgren.

SUMMARY OF THE INVENTION

Simplicity was an object of Charles Halgren, the inventor of U.S. Pat. No. 3,306,086, and the invention of Mr. Halgren well achieved that object. Despite the difficulty of achieving further simplicity in the invention of Mr. Halgren, such further simplicity was a principal object of the inventor of this invention.

Another principal object of the inventor in making this invention was the achievement of further simplicity over the invention of Mr. Halgren, without the sacrifice of the other achievements and advantages of the invention of Mr. Halgren.

Thus, in a principal aspect among other principal aspects, the invention is a lock assembly comprising a housing, a crank, a slider, a catch, and a single biasing means. The crank is mounted to the housing to be pivoted relative to the housing. The slider is linked to the crank and adapted to be slid relative to the housing to and from a locking position. The catch is mounted to the housing and adapted to releasably catch the slider in the locking position. The single biasing means is mounted to the housing and linked to the slider for (a) biasing the slider from the locking position, and (b) biasing the catch to catch the slider when the slider is in the locking position.

As compared with the invention of Mr. Halgren, the present invention eliminates the two biasing means of Halgren in favor of a single, multipurpose biasing means, while retaining all the benefits and advantages of the Halgren structure.

The full range of objects, aspects and advantages of the present invention are best understood by a reading of the detailed description of the preferred embodiment, which follows.

BRIEF DESCRIPTION OF THE DRAWINGS

The preferred embodiment of the invention will be described in relation to the accompanying drawing. The drawing includes five figures or FIGS., as follows:

FIGS. 1-4 depict the preferred garage door lock mechanism in an open or unlocked condition. FIG. 5, in contrast, depicts the preferred garage door lock mechanism in a closed or locked condition.

Figure 1:
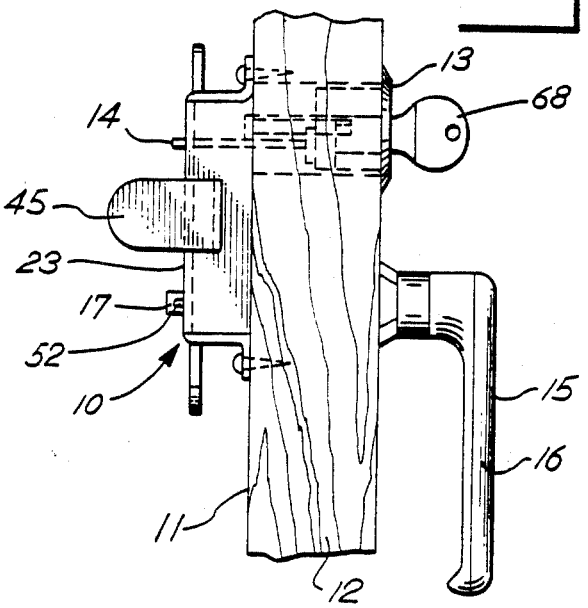
FIG. 1 is a side elevational view of a portion of a garage door including the preferred garage door lock mechanism of the invention.

In the detailed description which follows, the preferred garage door lock mechanism and its various components will be described with the use of terms of physical orientation such as "top," "bottom," "left" and "right". Such terms are intended as an aid for the understanding of the preferred embodiment in relation to the accompanying drawings, and are not intended to limit the claims. The invention in the preferred garage door lock mechanism may be employed in a variety of physical orientations different from the orientation illustrated in the drawing.

DETAILED DESCRIPTION OF THE PREFERRED EMBODIMENT

The preferred embodiment of the present invention is illustrative of the present invention, and except to the extent limitations of the preferred embodiment are included in the claims, the preferred embodiment is not restrictive of the subject matter regarded as invention. The title and abstract are also considered to be not restrictive of the scope of the subject matter regarded as invention.

Referring to FIG. 1, the preferred embodiment of the present invention is a garage door lock assembly 10 mounted principally on the interior surface 11 of a garage door 12. This door may be one of a pair of vertically hinged doors or it may be an overhead door. A rim cylinder lock 13 is mounted on the exterior of the door in an appropriate opening in the door, with a rearwardly extending tail piece 14. A handle assembly 15 is mounted on the door below the rim cylinder lock 13. The handle assembly 15 includes a handle 16 having a rearwardly extending spindle 17 with a square cross-section. The handle 16 is vertically aligned below and spaced from the rim cylinder lock 13.

Figure 2:
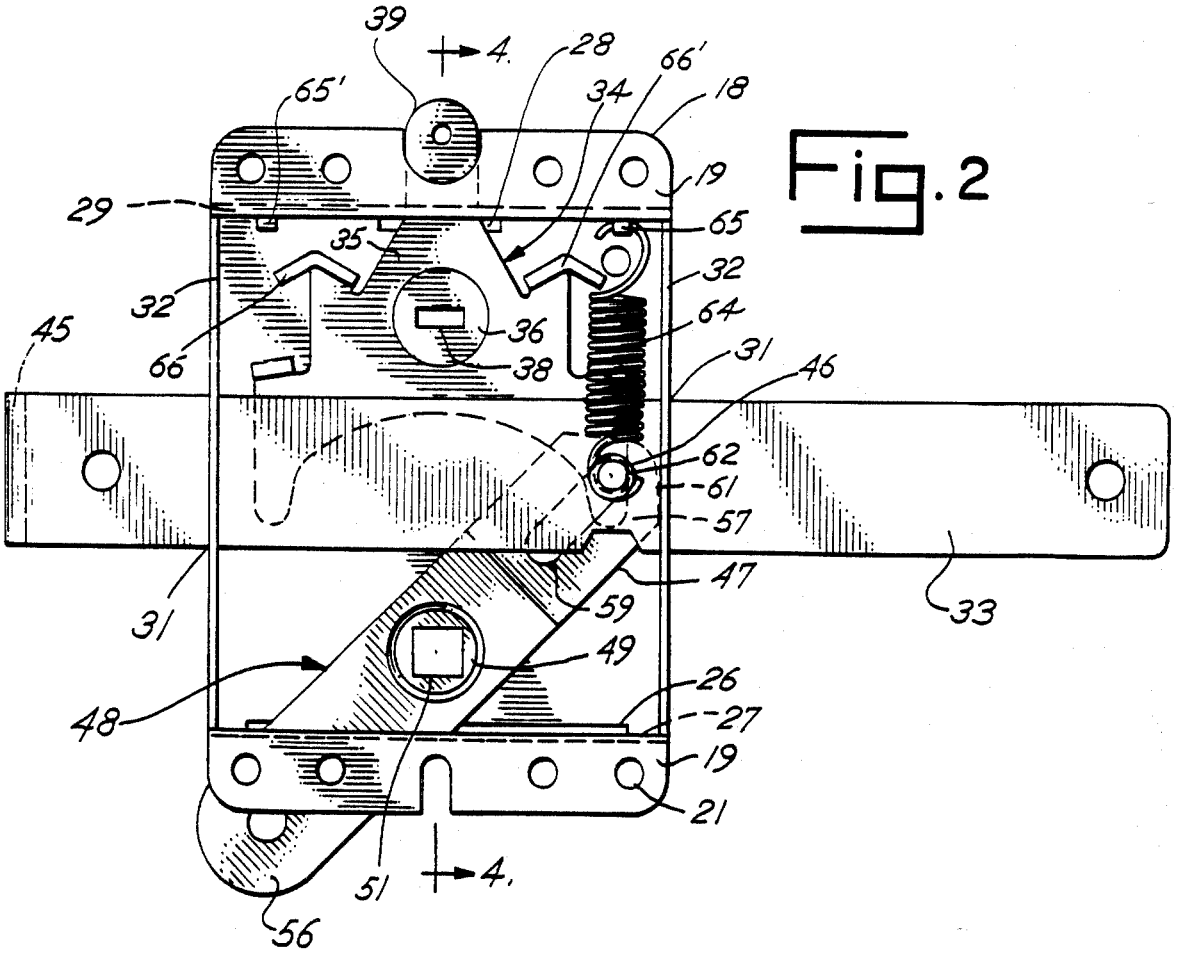
FIG. 2 is a front elevational view of the preferred garage door lock mechanism, taken along line 2—2 in FIG. 1.
Figure 4:
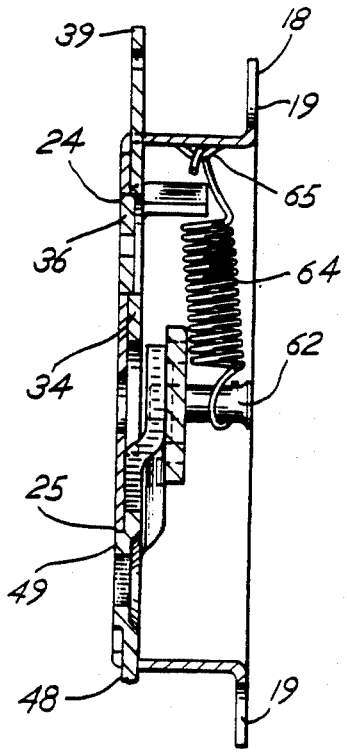
FIG. 4 is a cross-sectional view of the preferred garage door lock mechanism, taken along line 4—4 of FIG. 2.
Figure 5:
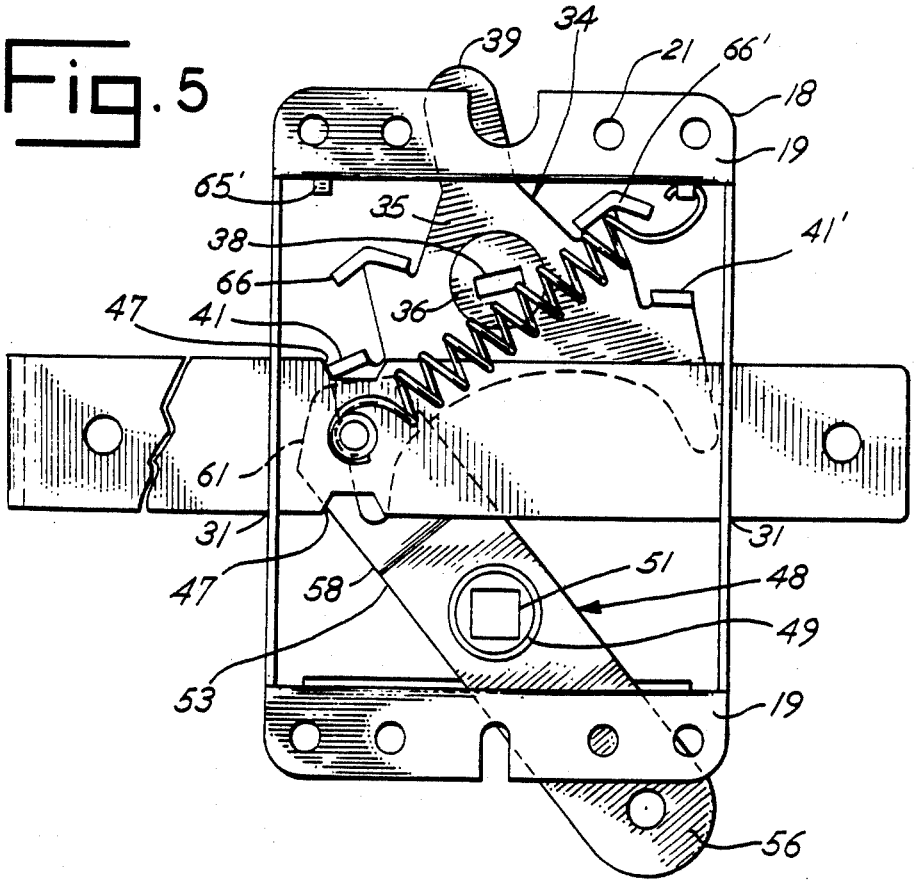
FIG. 5 is a second front elevational view of the preferred garage door lock mechanism.

The garage door lock assembly 10 includes a generally rectangular metal housing 18, shown best in FIGS. 2, 4 and 5. The housing 18 includes upper and lower mounting flanges 19 having openings 21 for suitable securing means such as wood screws (not shown) for attaching the housing 18 to the interior surface 11 of the door 12. The rear wall 23 of the housing 18 is spaced away from the interior surface 11 of the door 12, as in FIG. 1, and includes a pair of vertically spaced openings 24, 25 aligned with the axes of the rotatable plug of the rim cylinder lock 13 and the cylinder 17. The housing 18 further includes an elongated slot 26, shown in FIGS. 2 and 5, in the lower wall 27 of the housing 18, and a short, centrally positioned slot 28 in the upper wall 29 of the housing 18, as in FIG. 2. Also, horizontally aligned openings 31 are positioned in the side walls 32 of the housing 18 to receive a slider such as a bolt 33.

Referring to FIGS. 2, 4 and 5, a catch 34 includes a flat plate 35 having a rearwardly extending, centrally positioned embossment or hub portion 36 providing a depression in the plate 35. The embossment 36 is circular and rotatably received in the upper opening 24, shown in FIG. 4, of the housing 18. The embossment 36 has a central rectangular slot 38, shown in FIGS. 2 and 5, extending therethrough and adapted to conformably receive the rear end of the tail piece 14 of the rim cylinder 13.

An upwardly extending release arm 39 on the plate 35 extends through the slot 28 to the exterior of the housing 18. The arm 39 is adapted to manually oscillate and actuate the catch 34, and release the bolt 33 from the interior of the garage door. The catch 34 further includes a pair of forwardly extending catch arms 41, 41', designated in FIG. 5.

The bolt 33 is formed of an elongated bar of any suitable length having a rearwardly extending flange or arm 45 at the free end opposite the locking end of the bolt. The bolt is provided with a punched opening 46 extending therethrough and located to be positioned within the housing 18. A pair of notches 47 vertically aligned with the opening 46 are formed on the opposite edges of the bolt to receive one of the arms 41, 41', depending upon whether the assembly is a right-hand or left-hand lock assembly. The assembly illustrated in FIGS. 1–5 is a left-hand assembly, with the flange 45 on the bolt 33 at the left-hand side of the housing 18, and the catch arm 41 cooperating with the adjoining notch 47 on the bolt 33, to lock the bolt in a locking position as in FIG. 5.

Below the bolt 33 is a pivotally mounted, oscillating crank 48. The crank 48 has an elongated arm with a generally centrally positioned circular embossment or hub portion 49 received in the lower opening 25, shown in FIG. 4, of the housing 18. The embossment 49 has a central, square opening 51 extending therethrough and adapted to conformably receive the square spindle 17 of the handle assembly 15. As shown in FIG. 1, the end of the spindle 17 extends through the housing 18 and is provided with a transverse opening to receive a roll or spiral pin 52, to retain the handle 16 in assembled relation to the housing 18.

The outer end 56 of the crank 48 extends through the lower slot 26 in the housing 18, to manually oscillate and actuate the crank 48, and drive the bolt 33 to its locking position. The inner end 57 of the crank 48 is offset forward at 58, and is provided with an elongated, longitudinally extending slot 59. A tapered portion 61 at the inner end 57 of the crank 48 is adapted to abut the interior surface of either sidewall 31, 32 of the housing 18 to limit movement of the crank 48. As best shown in FIG. 4, a bolt pin 62 links the crank 48 with the bolt 33. As shown in FIG. 2, the bolt pin 62 is rigidly held within the opening 46 in the bolt 33. The pin 62 extends from the bolt 33 through the slot 59 in the crank 48. The pin 62 does not engage the catch 34.

Figure 3:
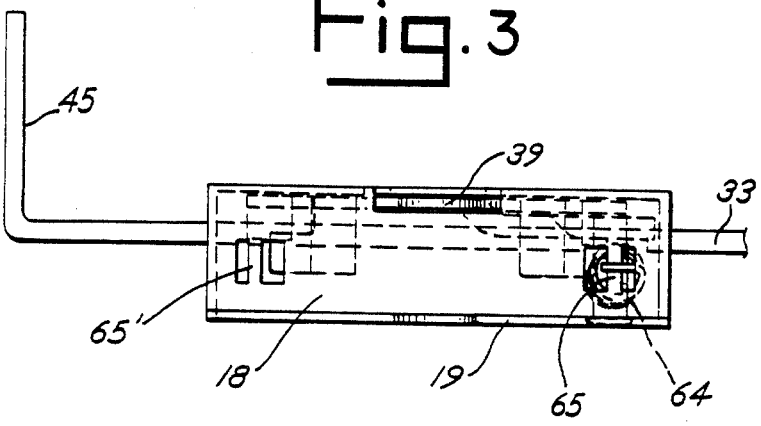
FIG. 3 is a top plan view of the preferred garage door lock mechanism.

Again as best shown in FIG. 4, a single spring 64 engages the pin 62 and a spring retainer 65 in a corner of the housing 18 on the upper flange 19 above the location of the pin 62 when the bolt 33 is in the unlocked position, as in FIGS. 2, 3 and 4.

The spring 64 is multipurpose, and takes the place of the two springs of U.S. Pat. No. 3,306,086. First, the spring 64 provides rapid and positive rotation of the crank 48, and retraction of the bolt 33 to the unlocked position, as in FIGS. 2–4.

Second, the catch 34 includes two forwardly extending ears 66, 66' above the arms 41, 41', respectively. The ears 66, 66' and the spring 64 are located such that with the bolt in the unlocked position as shown in FIG. 2, the ears and the spring are free of physical contact. The ears and spring are further located such that as the bolt is slid toward the locking position as in FIG. 5, the spring 64 contacts an ear. The contact of the spring with the ear pivots the ear and thereby the catch 34 until one of the arms 41, 41' contacts the edge of the bolt 33. Further movement of the bolt 33 causes the spring to be pressed against the ear, which can move no further until the arm resting against the bolt 33 reaches a notch 47 in the bolt. As a result of the inability of the catch to move further until the arm reaches the notch, the contact of the spring with the ear displaces the spring laterally, causing a lateral spring force in the spring. When the bolt 33 reaches the locking position, the notch 47 aligns with the arm of the catch resting against the bolt 33, and the lateral force in the spring 64 drives the arm into the notch 47. The spring 64 remains displaced laterally slightly, as in FIG. 5, to aid the abutment of the arm 47 with the edge of the notch 47 in keeping or locking the bolt 33 in the locking position.

It should be noted that the catch 34, the crank 48, and the housing 18 are symmetrically formed so as to be effective for either a right-hand or a left-hand lock assembly. To convert from the assembly as shown to a right-hand assembly, the spring 64 is removed; the pin 62 is removed; the bolt 33 is removed, reversed and replaced, with the flange 45 on the right-hand side of housing 18; the pin 62 is replaced; and the spring 64 is returned to the assembly with the upper end attached to a second spring retaining flange 65' on the housing 18.

As perceived by a human operator desiring to lock or unlock a garage door, the lock mechanism 10 operates as follows. With the bolt 33 in the retracted position of FIG. 2, and with the door 12 closed, the operator turns the handle 16 in a counter-clockwise direction to rotate the crank 48 in the counter-clockwise direction against the force of the spring 64. Pivoting of the crank 48 causes longitudinal, sliding movement of the bolt 33 to its locked position, with the slot 59 in the crank 48 allowing horizontal movement of the pin 62 although the inner end 57 of the crank has an arcuate movement. As the bolt 33 nears the locked position, the spring 64 contacts the ear 66' and urges the arm 41 on the catch 34 against the bolt 33. As the bolt 33 reaches the locked position, the spring 64 urges the arm 41 downward into the notch 47. The door 12 is now locked, and the assembly 10 is as shown in FIG. 5.

To release the bolt 33 and thereby unlock the door 12, the operator inserts the proper key 68 in the rim cylinder lock 13 and rotates the key clockwise. This action causes rotation of the tail piece 14, and therethrough, clockwise rotation of the catch 34. The arm 41 is lifted from the notch 47 against the lateral force of the spring 64. The force in the spring 64, caused by its previous longitudinal extension, provides rapid and positive pivoting of the crank 48 and retraction of the bolt 33.

The door may be locked from the inside of the garage or other enclosure having the door 12 by manual movement of the bolt 33, with the operator grasping the flange 45, or by manual movement of the exterior end 56 of the crank 48. The door may be unlocked from the inside by manual movement of the release arm 39 of the catch 34, to release the arm 41 from the notch 47 in the bolt.

If desired, as with a garage door of the overhead type, the assembly 10 may be center mounted on the door 12 with an added bolt linkage attached to the outer end 56 of the crank 48, to provide bolt linkages extending to latching engagement at both edges of the door.

The invention and the preferred embodiment thereof are now described in such full, clear, concise and exact terms as to enable a person of ordinary skill in the art to make and use the same. As should be apparent, the preferred embodiment of the present invention may be modified in a variety of ways without departing from the invention. As an example, a non-bolt slider may be substituted for the bolt 33 passing through the housing 18, and the bolt 33 may be attached to the outer end 56 of the crank 48. As another example, the single, multipurpose spring 64 may be replaced by other single, multi-purpose biasing means. Therefore, to particularly point and distinctly claim the subject matter regarded as invention, the following claims conclude this specification.

What is claimed is:

1. A lock assembly comprising:

a housing;

a slider;

a crank mounted to the housing and linked to the slider adpated to slide the crank relative to the housing to and from a locking position;

a catch mounted to the housing adapted to releasably catch the slider in the locking position; and a single, multipurpose biasing means mounted to be in tension and connecting the housing to the slider for biasing the slider from the locking position and biasing the catch to catch the slider when the slider is in the locking position, said biasing means being otherwise independent of support by the housing, slider, crank and catch.

2. A lock assembly as in claim 1 in which the slider is a lock bolt.

3. A lock assembly as in claim 1 in which the crank is mounted to the housing to be pivoted and further comprising a handle adapted to be mounted to the crank for pivoting the crank.

4. A lock assembly as in claim 1 further comprising means adapted to be mounted to the catch for manually releasing the slider from the locking position.

5. A lock assembly as in claim 4 in which the catch is mounted to be pivoted and the means for manually releasing the slider includes key lock means with a key for pivoting the catch.

6. A lock assembly as in claim 1 in which the single, multipurpose biasing means is a spring and the catch includes an arm projecting toward the spring, the spring adapted to connect the arm and thereby bias the catch as the slider moves toward the locking position.

7. A lock assembly as in claim 1 adapted to be a garage door lock mechanism in which the housing is adapted to be mounted to the garage door, the crank is mounted to the housing to be pivoted and includes a crank hub portion adapted to receive a spindle, the slider is a garage door bolt, and the catch is mounted to the housing to be pivoted and includes a catch hub portion adapted to receive a key lock tail piece, the assembly further comprising a handle including a spindle adapted to be mounted through the door, adapted to be received by the crank hub portion and adapted to drive the crank and thereby the bolt to the locking position, and key lock means including a key and key lock tail piece adapted to be mounted through the door, adapted to be received by the catch hub portion, and adapted to drive the catch and thereby release the bolt from the locking position.

8. A lock assembly as in claim 7 in which the single, multipurpose biasing means is a spring and the catch includes an arm projecting toward the spring, the spring adapted to contact the arm and thereby bias the catch as the slider moves toward the locking position.

* * * * *